US006851249B1

(12) United States Patent
Darcy, III et al.

(10) Patent No.: US 6,851,249 B1
(45) Date of Patent: Feb. 8, 2005

(54) PACKAGING MACHINE AND METHOD FOR WRAPPING AND FOLDING FLEXIBLE PHOTORECEPTOR BELTS

(75) Inventors: John J. Darcy, III, Webster, NY (US); David W. Martin, Walworth, NY (US); Michael S. Roetker, Webster, NY (US); James F. Dildine, Jr., Williamson, NY (US); Moritz P. Wagner, Walworth, NY (US); J. Stephen Olesiuk, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/625,206

(22) Filed: Jul. 23, 2003

(51) Int. Cl.[7] ..... B65B 51/06; B65B 63/04

(52) U.S. Cl. ..... 53/415; 53/416; 53/430; 53/118; 53/136.3; 53/138.1

(58) Field of Search ..... 53/429, 430, 116, 53/118, 415, 416, 136.3, 138.1, 228–233, 64, 66, 466

(56) References Cited

U.S. PATENT DOCUMENTS 1,784,366 A * 12/1930 Littlefield ..... 53/430
2,732,063 A * 1/1956 Dedek ..... 53/430
2,868,369 A * 1/1959 Webb ..... 242/160.2
3,186,543 A * 6/1965 Minick et al. ..... 53/430
3,501,889 A * 3/1970 Grulick et al. ..... 53/116
3,694,998 A * 10/1972 Brinkley et al. ..... 53/116
4,162,009 A * 7/1979 Schouten ..... 242/160.2
5,119,133 A * 6/1992 Swain ..... 206/389
5,282,345 A * 2/1994 Darcy et al. ..... 53/118

* cited by examiner

*Primary Examiner*—Stephen F. Gerrity
(74) *Attorney, Agent, or Firm*—Tallam I. Nguti

(57) ABSTRACT

A packaging machine and method are provided for wrapping, folding and taping a flexible photoconductive belt loop to prevent light from shocking such photoconductive belt loop during shipping and during loading into a machine. The packaging machine for the method includes mandrels holding cylindrical cores for supporting, tensioning and folding the flexible photoconductive belt loop; devices for feeding a light occluding and protective flexible sheet over the flexible photoconductive belt loop to form a belt and sheet assembly; an aperture former for forming a loop tacking aperture through a loop tacking portion of one end of the light occluding and protective flexible sheet; folding and end-tucking mechanisms for folding the belt and sheet assembly into a tightly folded pattern around the cylindrical cores; and first and second taping stations for applying an end pull tab tape, and a loop tacking tape over the loop tacking portion and through the loop tacking aperture onto a portion of the light occluding and protective flexible sheet underneath the loop tacking portion thereof.

22 Claims, 11 Drawing Sheets

PACKAGING MACHINE AND METHOD FOR WRAPPING AND FOLDING FLEXIBLE PHOTORECEPTOR BELTS

RELATED CASE

This application is related to U.S. application Ser. No. 10/625,192 entitled "PACKAGING APPARATUS FOR WRAPPING AND FOLDING FLEXIBLE PHOTORECEPTOR BELTS" filed on Jul. 23, 2003 herewith, and having at least one common inventor.

The present invention relates generally to flexible photoreceptor belts, and more particularly to a packaging machine and method for wrapping and folding a flexible photoconductive belt loop so as to prevent light from shocking it during shipping and during loading into an image producing machine, such as an electrostatographic image reproduction machine.

In the art of electrostatography, a photoconductive member including an insulating photoconductive layer on a conductive layer is imaged by first electrostatically charging the imaging surface of the photoconductive insulating layer. The photoconductive member is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As is well known, the photoconductive member may be in the form of a flexible photoreceptor belt. These flexible belts have a substrate and sensitive layers that include an electrically conductive surface and at least one photoconductive layer. A common flexible photoreceptor belt comprises a substrate, a conductive layer, an optional hole blocking layer, an optional adhesive layer, a charge generating layer, a charge transport layer and, in some embodiments, an anti-cud backing layer.

These photoreceptor belts are usually thin and flimsy, but most importantly, they are very sensitive to light. Accordingly, during handling of these belts when shipping or loading them into an image reproduction machine, damage such as scratches, dents can result, and light shock can result if the belts are exposed for significant periods to light. Such damage ordinarily can lead to degradation in the quality of images produced thereon by the reproduction machine.

There is therefore a need for a packaging machine that can wrap and fold a flexible photoconductive belt loop so as to prevent light from shocking it during shipping and during loading into an image producing machine.

In accordance with the present invention, there is provided a packaging machine and method for wrapping, folding and taping a flexible photoconductive belt loop to prevent light from shocking such photoconductive belt loop during shipping and during loading into a machine. The packaging machine for the method includes mandrels holding cylindrical cores for supporting, tensioning and folding the flexible photoconductive belt loop; devices for feeding a light occluding and protective flexible sheet over the flexible photoconductive belt loop to form a belt and sheet assembly; an aperture former for forming a loop tacking aperture through a loop tacking portion of one end of the light occluding and protective flexible sheet; folding and end-tucking mechanisms for folding the belt and sheet assembly into a tightly folded pattern around the cylindrical cores; and first and second taping stations for applying an end pull tab ape, and a loop tacking tape over the loop tacking portion and through the loop tacking aperture onto a portion of the light occluding and protective flexible sheet underneath the loop tacking portion thereof.

In the detailed description of the invention presented below, reference is made to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
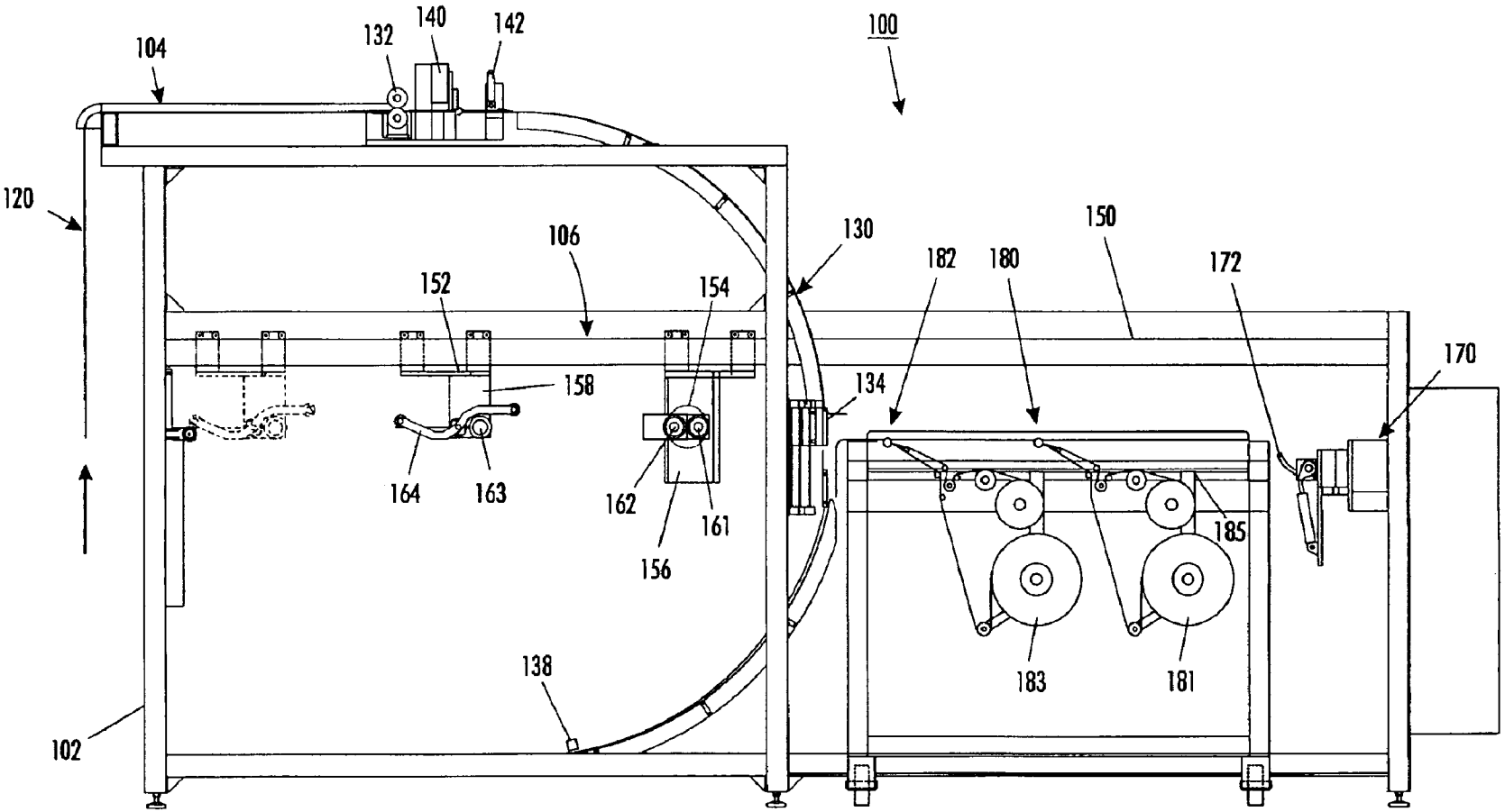
FIG. 1 is a schematic vertical view, in an idle mode, of the packaging machine of the present invention for wrapping photo paper about a flexible photoconductive belt loop.

Referring to FIG. 1, it depicts a schematic illustration of a packaging machine 100 of the present invention for automatically wrapping a is light occluding and protective flexible member, such as protective photo paper 121, about a light sensitive flexible photoconductive belt loop 110. The flexible light occluding photo paper in one embodiment is black photo paper. The light sensitive photoconductive belt loop 110 is a flexible photoreceptor or photoconductive belt having a length or circumference L1, and a width W1. The packaging machine 100 includes a machine frame 102, a protective photo paper supply assembly 104, and photoconductive belt support and folding assembly 106.

The protective photo paper supply assembly 104 includes a web supply stand (not shown) for holding a photo paper web 120, a paper guide, for example an arc-shaped paper guide 130 for guiding and freely holding a cut length L2 of photo paper web 121, and a feeding device 132 for feeding photo paper web 120 along the arc-shaped paper guide 130. The paper guide 130 as illustrated may be an arc-shaped baffle that has an opening or gate 134 through it, at approximately the mid-point thereof. In order to facilitate efficient paper feeding, a movable shutter 136 is provided for closing the opening or gate 134 during feeding of a lead end 122 of paper to the lead-end sensor 138.

The protective photo paper supply assembly 104 also includes a paper lead-end sensor 138 for detecting the absence or presence of a lead end 122 of the length L2 of photo paper web 120 fed along the paper guide 130. Back upstream of the lead-end sensor 138, relative to a direction of photo paper feed, there is provided a paper cutter 140 for cutting the photo paper web 120 when the lead end 122 of such web triggers the lead-end sensor 138. Cutting the web as such defines a trail end 124 of a cut sheet of the photo paper web having the desired length L2 for use in completely wrapping the flexible photoconductive belt 104.

According to one aspect of the present invention, the protective photo paper supply assembly 104 also includes an aperture former 142 located along the paper guide 130. The aperture former 142 is located as such slightly downstream of the paper cutter 140 for forming at least one loop tacking aperture 128, 129 completely through a trail-end or loop tacking portion 126 of the cut sheet of photo paper 121. In one embodiment, the aperture former 142 forms two such tacking apertures 128, 129 and in a centralized manner relative to the width W2 of the cut sheet of photo paper.

The photoconductive belt support and folding assembly 106 includes a loading/unloading and wrapping station AA that is located above a first portion 131 of the arc-shaped paper guide 130, and underneath a second portion 133 of the arc-shaped paper guide. A translational travel track 150 as well as a translational first drive means 152 and a rotational second drive means 154, form parts of the wrapping station AA and photoconductive belt support and folding assembly 106. The photoconductive belt support and folding assembly 106 also includes a first movable carriage 156 having a first mandrel 161 and a second mandrel 162 each for supporting first and second packaging core members C1 and C2, respectively. In one embodiment, the packaging core members comprise cylindrical paper cores. The first movable carriage 156 is coupled both to the translational first drive means 152, and to the rotational second drive means 154. As mounted on the first movable carriage 156, the first mandrel 161 and the second mandrel 162 can be rotated on a pivot Pv about each other, by means of the rotational second drive means 154. The photoconductive belt support and folding assembly 106 further includes a second movable carriage 158 having a third mandrel 163 for supporting a third packaging paper core C3, and a photo paper web hold-down finger 164. The hold-down finger 164 has a home position and tucking position, and is rotatable about 180 degrees between the home and tucking positions.

As further illustrated, the photoconductive belt support and folding assembly 106 includes a folding station BB that has a tucking device 170 for tucking the trail end overhanging portion 122, 123 of the cut sheet of photo paper around a folded assembly 200 of the photoconductive belt loop and the cut sheet of photo paper. The photoconductive belt support and folding assembly 106 further includes a first taping station 180 for applying a loop tacking tape and label 184, and a second taping station 182 for applying a pull tab tape 186 to the tightly folded belt and paper assembly 200. The first and second taping stations 180, 182 are located adjacent the travel track 150, and include appropriate tape supplies 181, 183, and each station is provided with necessary proximity sensors for sensing the reciprocal travels of the first and second movable carriages 156, 158 along he travel track 150.

Figure 2:
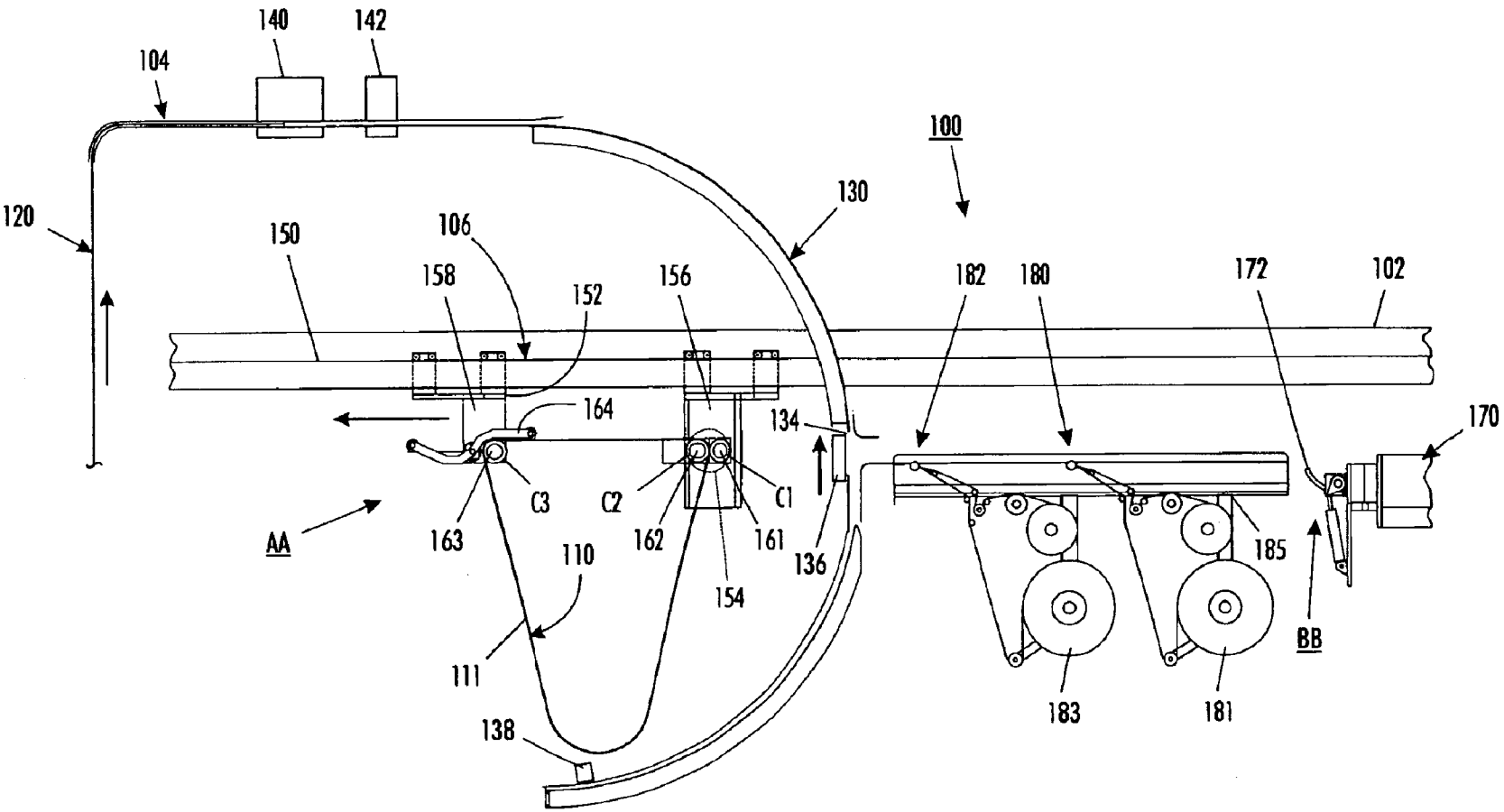
FIG. 2 is a schematic of the machine of FIG. 1 in a loop loading mode showing a just loaded flexible photoconductive belt loop.
Figure 3:
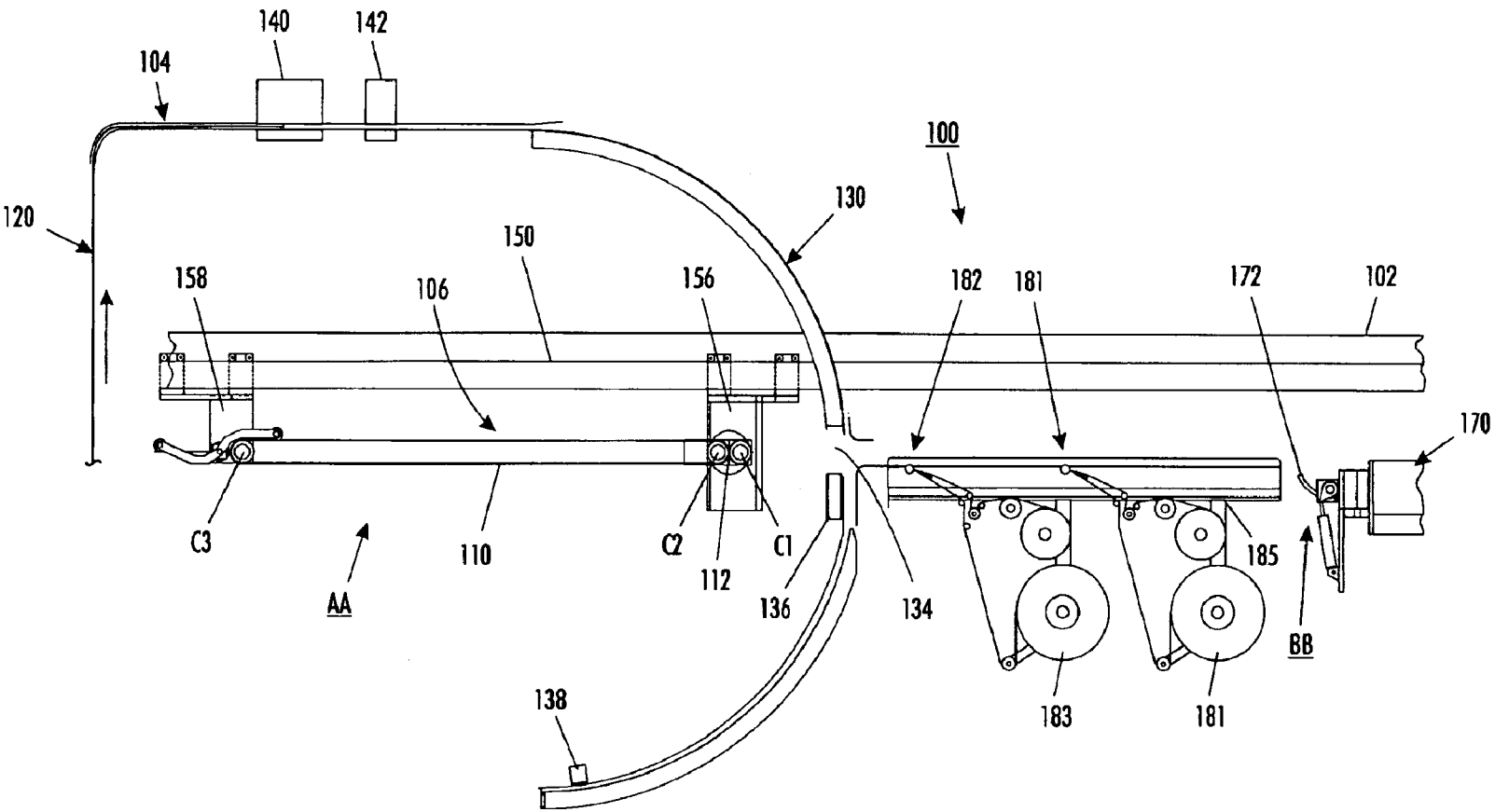
FIG. 3 is a schematic of the machine of FIG. 2 in a loop tensioning mode showing the loaded flexible photoconductive belt loop tensioned.

Referring in general to FIGS. 1–9, the packaging machine 100 is shown in FIG. 1 in an idle mode with nothing on the mandrels 161, 162, 163. In FIG. 2, it is shown in loop loading mode with removable hollow packaging cores or core members C1, C2, and C3 mounted over the mandrels 161, 162, 163 respectively, and a flexible photoconductive belt loop 110 loaded over the first and second cores C1 and C2. In FIG. 3 the machine 100 is in a loop tensioning mode showing the loaded flexible photoconductive belt loop 110 tensioned by the second movable carriage 158 for example being moved leftwards from its FIG. 2 position.

Figure 4:
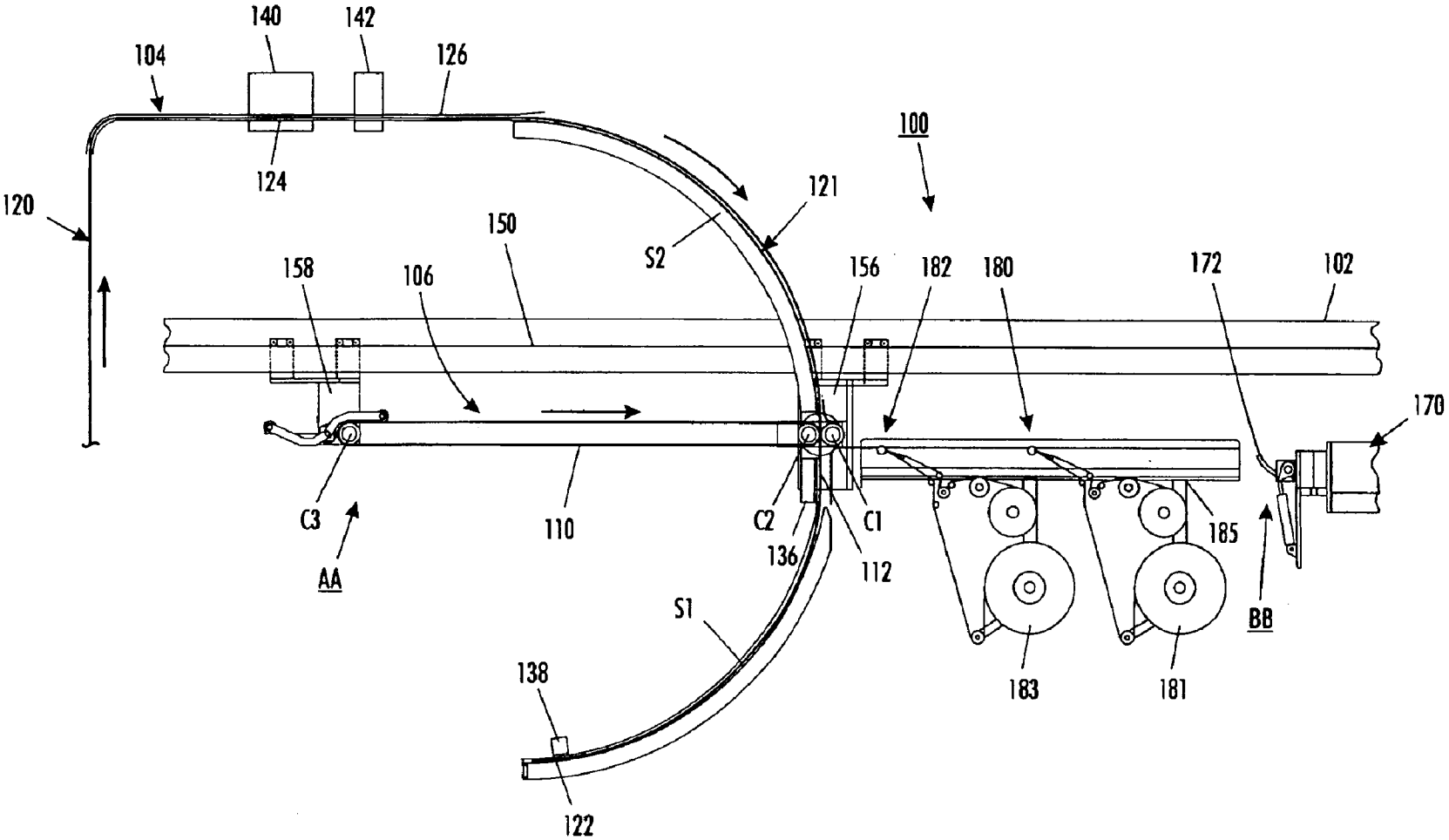
FIG. 4 is a schematic of the machine of FIG. 3 in a photo paper feeding mode showing the loaded flexible photoconductive belt carrying carriages positioned for receiving a photo paper web section.
Figure 5A:
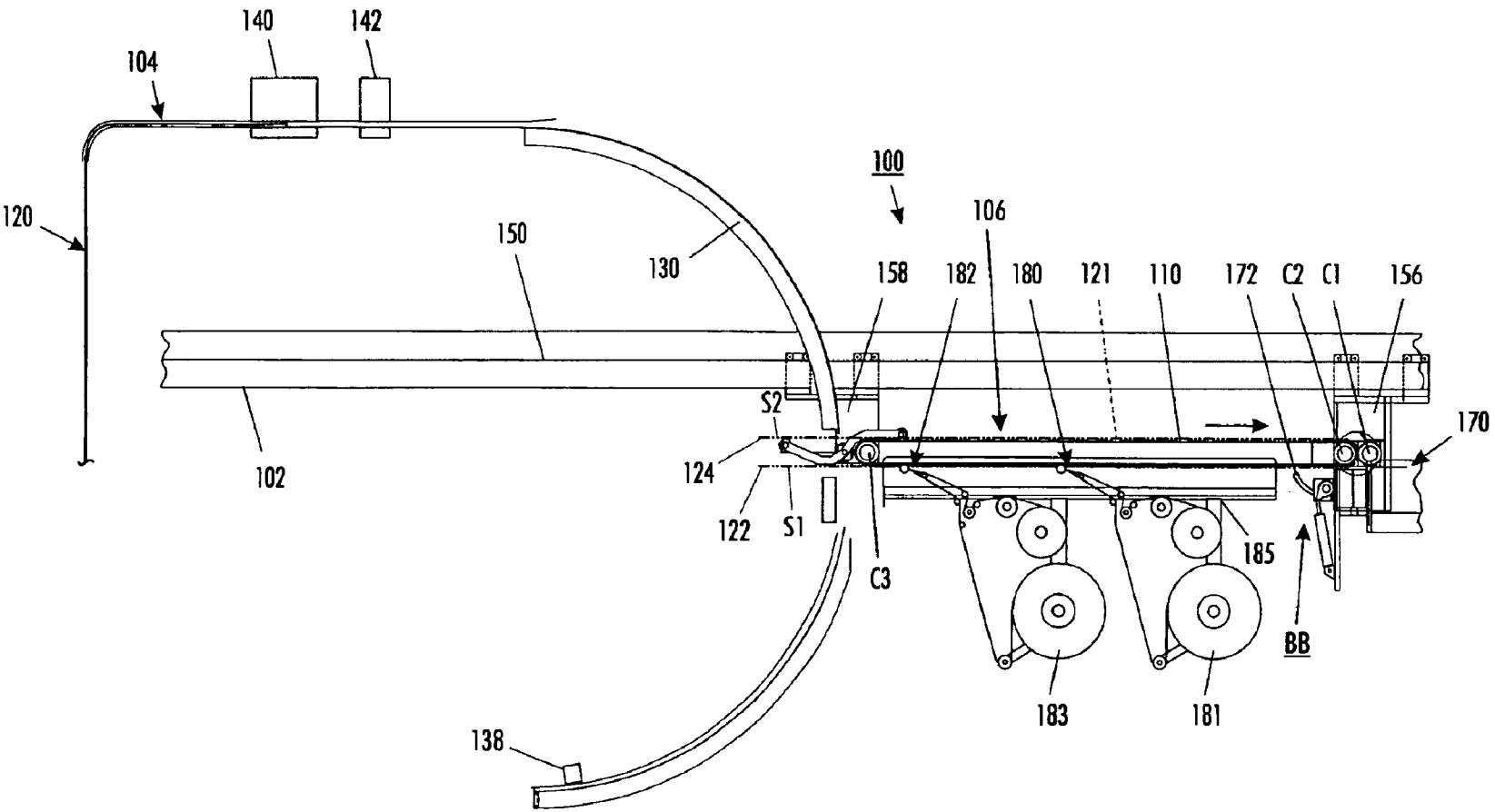
FIG. 5A is a schematic of the machine of FIG. 4 showing a belt and paper wrapped assembly moved to the folding station.
Figure 5B:
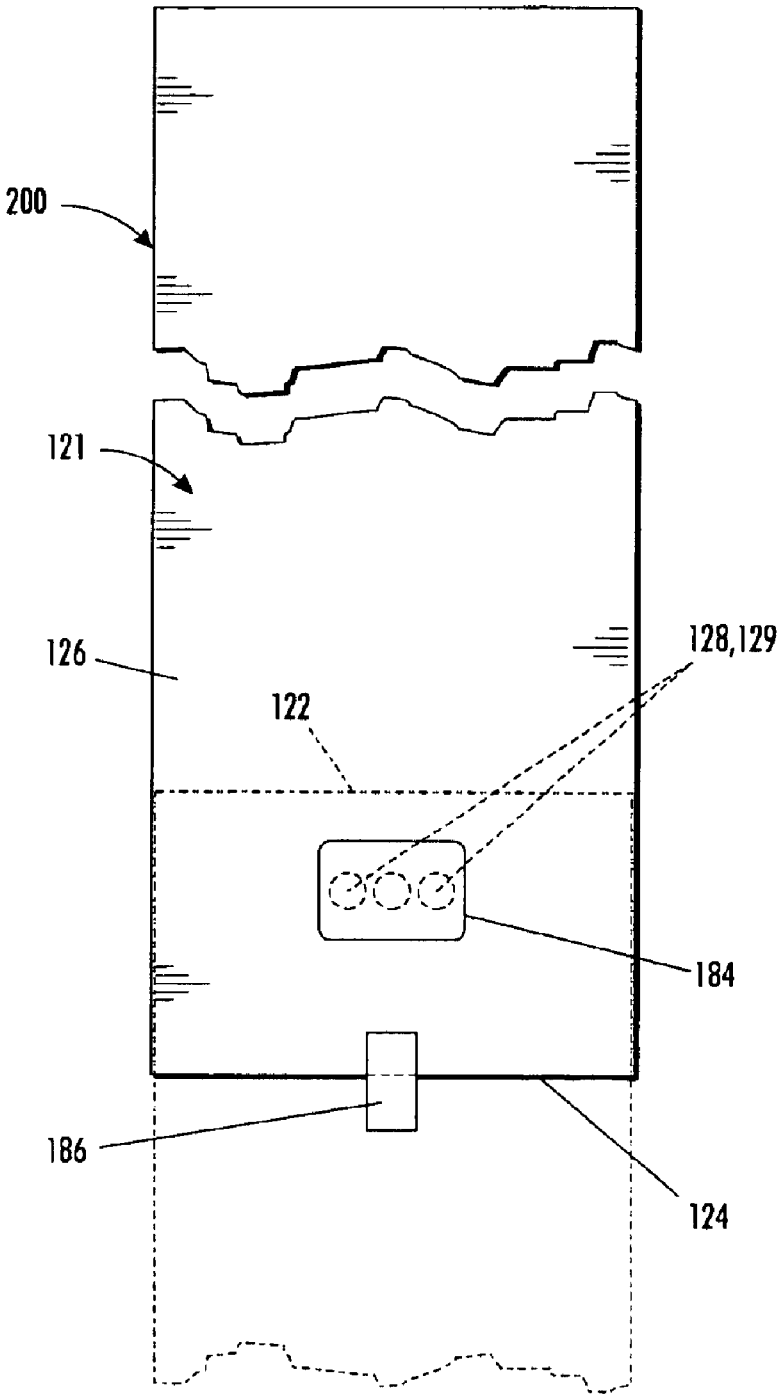
FIG. 5B is a schematic illustration of a part of the wrapped assembly showing the portions of the cut sheet of photo paper in accordance with the present invention.

In FIG. 4, the machine 100 is in a photo paper feeding mode showing the loaded flexible photoconductive belt loop carrying carriages 156, 158 positioned with the threading gap 112 under the arc-shaped paper guide 130 for receiving a photo paper web 120. FIG. 5A shows a belt and paper wrapped assembly 116 moved to the folding station BB ready to be folded and taped in accordance with the present invention. FIG. 5B is a schematic illustration of portions of the cut sheet of photo paper 121 and the loop tacking and pull tab tapes 184, 186 in accordance with the present invention.

Figure 6:
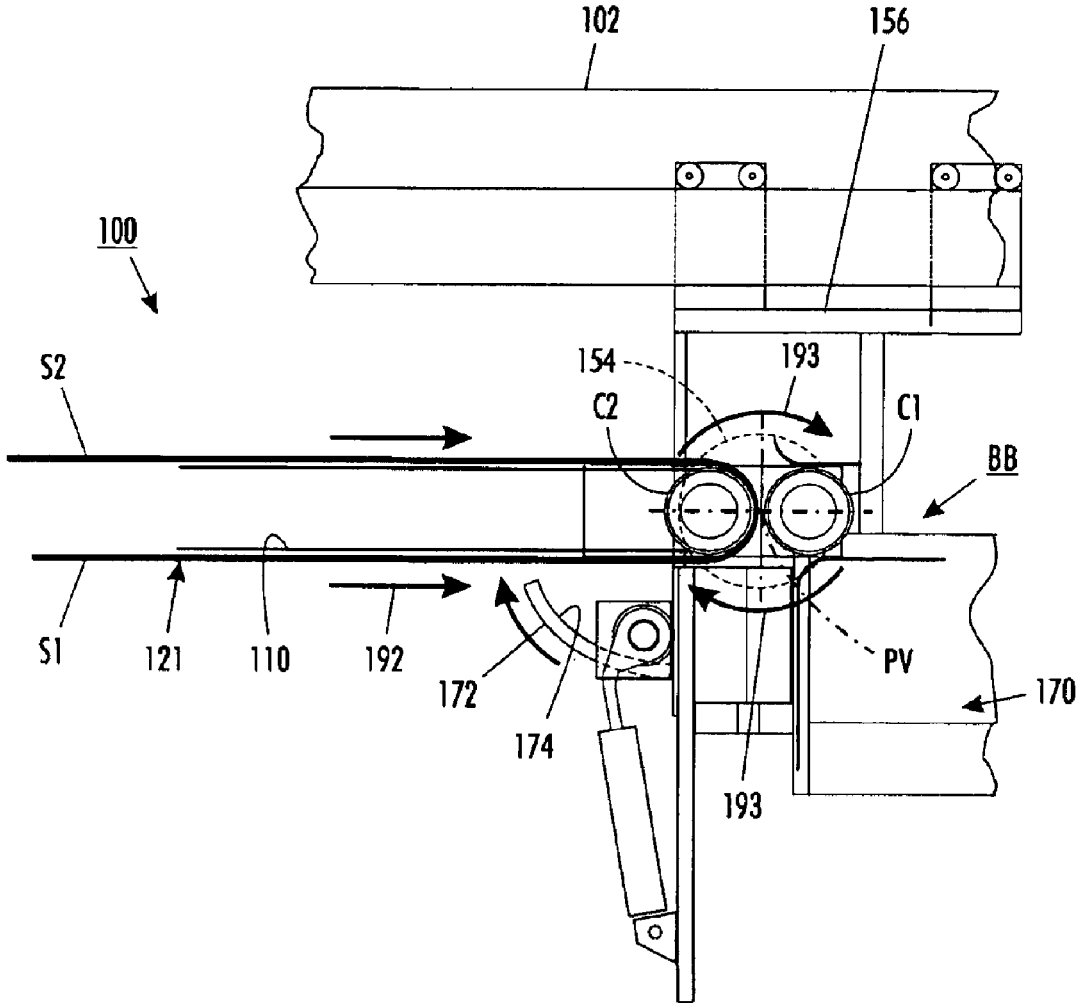
FIG. 6 is an enlarged illustration of the folding station showing a portion of the belt and paper wrapped assembly about to be folded.
Figure 7:
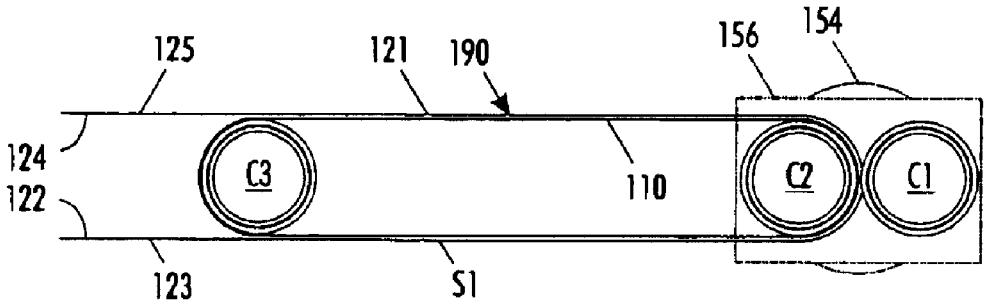
FIGS. 7–12 are schematic illustrations of the folding and taping of the belt and paper wrap-assembly in accordance with the present invention.
Figure 8:
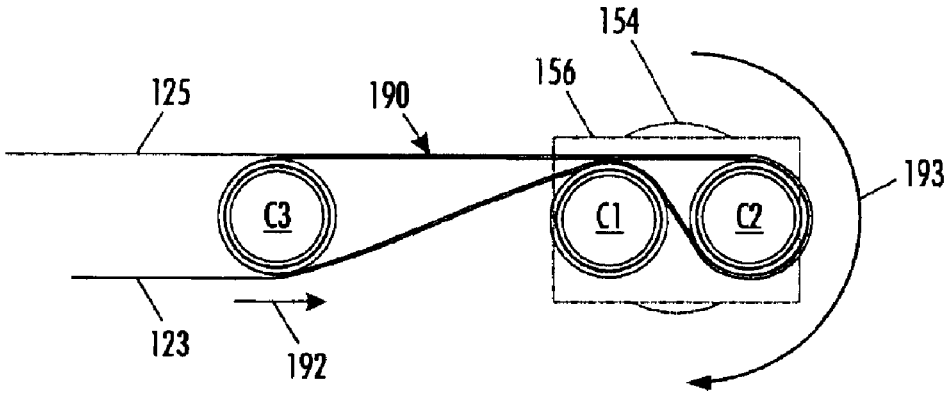
Figure 9:
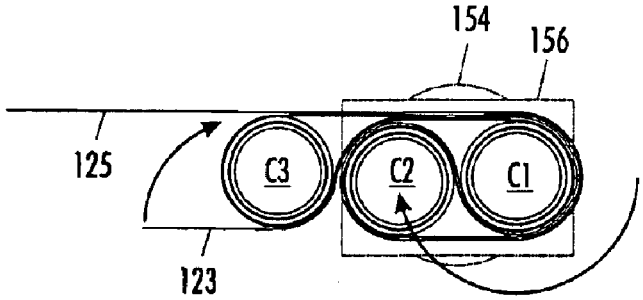
Figure 10:
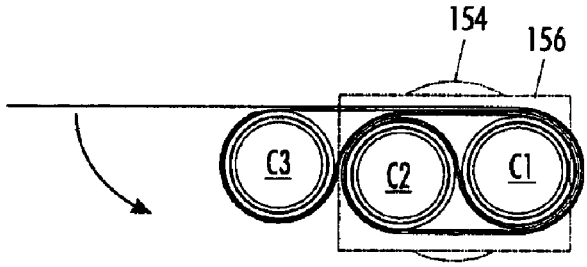
Figure 11:
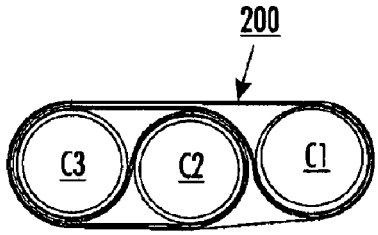
Figure 12:
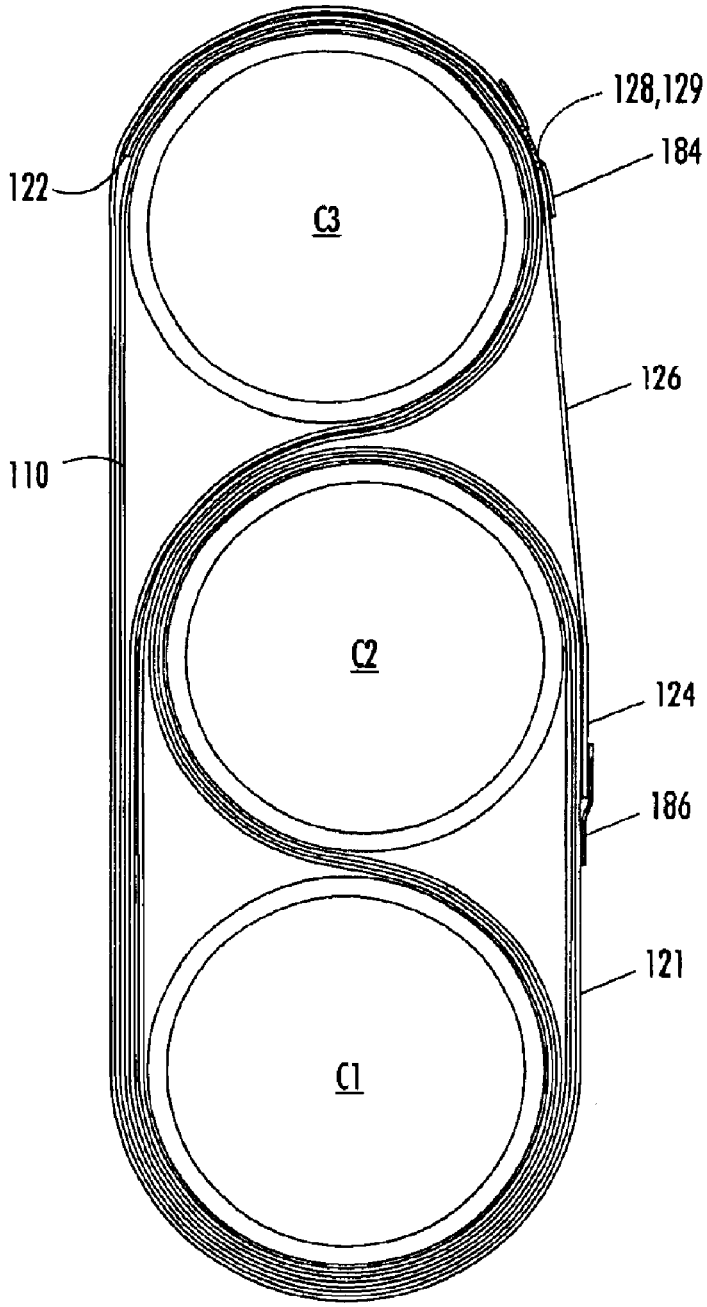
Figure 13:
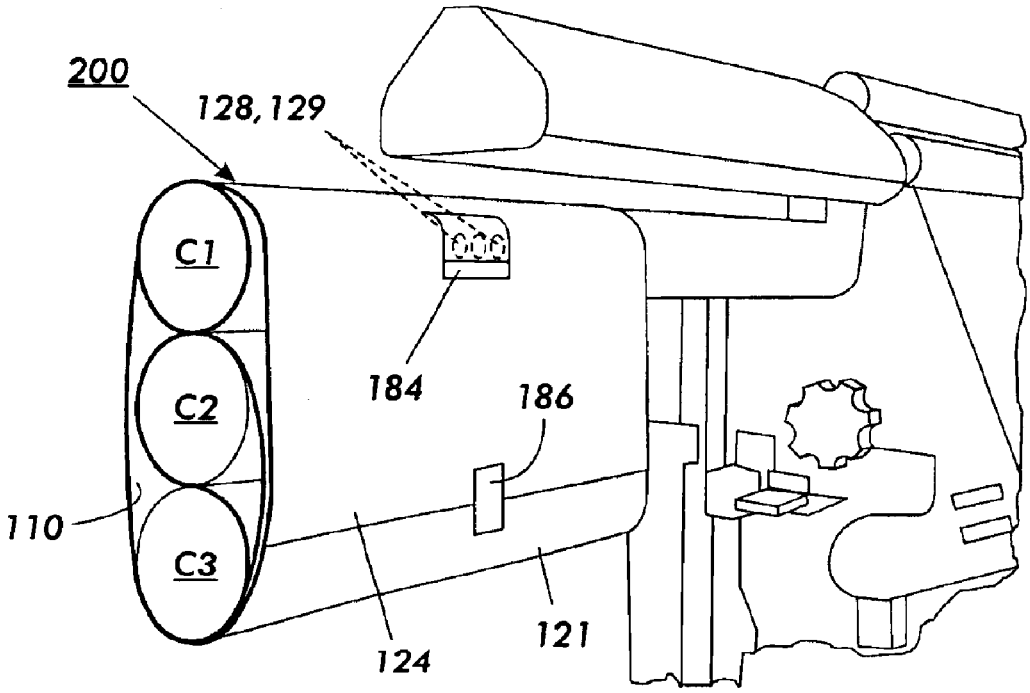
FIG. 13 is an illustration of the taped, tightly folded belt and paper assembly produced in accordance with the present invention.

FIG. 6 is an enlarged illustration of the folding station BB showing a portion of the wrapped assembly 190 about to be folded, and FIGS. 7–12 are schematic illustrations of the folding and taping of the wrapped assembly 190 into a tightly folded belt and paper assembly 190 in accordance with the present invention. Finally, FIG. 13 is an illustration of the taped, tightly folded belt and paper assembly 200 produced in accordance with the present invention.

Referring specifically now to FIGS. 1–4, with the first and second carriages are arranged in their first positions at the loading/unloading and wrapping station AA of the machine 100 as shown in FIG. 2. The hollow cylindrical packaging core members C1, C2, C3, for example cylindrical paper cores, are initially inserted over the first, second and third mandrels 161, 162, 163 of the first and second movable carriages 156, 153. The flexible photoconductive loop 110 is then hung over the second core C2 on the second mandrel 162 of the first movable carriage 156, and over the third core C3 on the third mandrel 163 of the second movable carriage 158, in a non-tensioned manner with a large portion 111 of the loop hanging gravitationally below the carriages 156, 158. The first mandrel/first core assembly 161/C1 is hinged so as to have an open position (defining the threading gap) and a closed or clamping position relative to the second mandrel/second core assembly 162/C2. In this manner, it allows for the feeding of the photo paper web through the threading gap, as well as for clamping the fed web against the loop 110 on the second mandrel/second core assembly 162/C2.

As shown in FIGS. 1 and 3, one or both of the first and second movable carriages 156, 158 is/are then moved translationally apart into their second positions (FIG. 3) for tensioning the photoconductive loop 110. As shown in FIG. 4, the first and second movable carriages 156, 158 are then moved to the right for locating the first movable carriage across the opening or gate 134 in the arc-shaped paper guide 130. The first carriage is located as such so that the first core C1 is to a first side of the paper guide 130, and the photoconductive belt loop 110 (as tensioned by the second and third mandrel/core assemblies 162/C2, 163/C3) is to the opposite side of the paper guide 130. As such, a threading gap 112 between the first and second cores C1, C2 is in line with a lead end of photo paper we being fed through the arc-shaped paper guide 130. The gate shutter 136 is then moved into place to close the gate 134 in the paper guide 130. A lead end 122 of the photo paper web 120 is then fed from the upper portion of the arc-shaped paper guide 130, across the closed gate 134 through the threading gap 112, to the lead-end sensor 138.

When the lead end 122 is sensed by the lead-end sensor 138, feeding is stopped. The cutter 140 then cuts the web resulting in a cut sheet of photo paper 121 having the length L2. The aperture former 142 forms the required number of apertures 128, 129 through the loop tacking portion 126 of the trail end of the cut sheet of photo paper 121. The cut sheet of photo paper 121 of length L2 is thus resting freely within the arc-shaped paper guide 130 with a first section S1 thereof below the gate 134 and a second section S2 above the gate. The arc-shaped paper guide is arranged such that a mid-point of the cut sheet of photo paper within the arc-shaped guide will be located below the gate 134 when the lead end 122 thereof is at the lead-end sensor 138. This results in the lower section S1 of photo paper being shorter than the upper section S2 thereof.

With the photo paper pinched as such, the aperture former 142 then punches at least one (e.g. 0.625 inch diameter) tacking hole or aperture 128, 129, (and in one embodiment two (e.g. 0.625 inch diameter) tacking holes or apertures 128, 129) through the loop tacking portion 126 of the trail end 124. The at least one tacking hole or aperture 128, 129 is punched centered width-wise relative to the paper width W2, and about five inches in from the trail end 124. The at least one tacking hole or aperture 128, 129, is provided for latter allowing the instruction and loop tacking tape 184 to fasten and tack the loop tacking portion 126 over, and to a portion of the lead end portion of the photo paper 121. This thus forms a photo paper protective loop 119 over the photoconductive belt loop 110. After the holes 128, 129 are punched as such, the photo paper web is then sheared or cut to provide the cut sheet of photo paper 121 of length L2 within the photo paper guide 130. The cut is such that L2 is significantly longer than L1 in order to provide the lead end and trail end overhanging portions 123, 125 (FIGS. 7 and 8) thereto.

With the cut sheet of photo paper 121 in the guide as such, the gate shutter 136 is removed leaving only the cut sheet of photo paper 121 across the opening or gate 134. With the first and second carriages 156, 158 in their second positions relative to each other, and with the photoconductive belt loop 110 tensioned as shown in FIGS. 3 and 4, the first mandrel/first core assembly 161/C1 is closed against the second mandrel/second core assembly 162/C2. Both carriages (with the tensioned photoconductive belt loop thereon) are then moved translationally (to the right) towards the folding station BB. During such translational movement, the first mandrel/core assembly 161/C1 with no belt or paper over it, (and located downstream of the gate 134 and downstream of the cut sheet of photo paper 121 relative to such movement), leads the way. However, the portion of tensioned photoconductive belt loop 110 over the second mandrel/core assembly 162/C2 (on the first carriage) will catch against the free cut sheet of photo paper 121 across the gate 134 and push it along and thus wrap sections S1 and S2 thereof over bottom and top portions of the outside surface of the tensioned photoconductive belt loop to form the wrapped assembly (paper on belt) 116.

Thus both the bottom section S1 and top section S2 of the free cut sheet of photo paper 121 in the arc-shaped paper guide will be pulled over the rest of the tensioned photoconductive belt loop 110. As such, the entire cut sheet of photo paper 121 having a length L2 is pulled out of the arc-shaped paper guide 130 and around most of the circumference L1 of the photoconductive belt loop 110. Translational movement as such continues across the taping stations, 182, 180 until the leading and free mandrel/core assembly 161/C1 reaches its position at the folding station BB. In accordance with the present invention, the length L2 of the cut sheet of photo paper is greater than the circumference L1 of the photoconductive belt loop 110, thus allowing for significant overlap (123, 125) by the photo paper at both lead end 122 and trail end 124 thereof.

After the leading and free, first mandrel/core assembly 161/C1 reaches its position at the folding station BB as described above, the rotational second drive means 154 is activated to rotatably move the first mandrel/first core assembly 161/C1 clockwise (FIG. 8) as shown by the arrow 193 around the second mandrel/second core assembly 162/C2, and vice versa (arrow 194) (with belt 110 and cut sheet of paper 121 over it). The first mandrel/first core assembly 161/C1 is referred to as the pinch core assembly, and the second mandrel/second core assembly 162/C2 is referred to as the winding core assembly. As pointed out above, as mounted on the first movable carriage 156, the first mandrel 161 and the second mandrel 162 can be rotated about each other on a pivot Pv by the rotational second drive means 154.

As illustrated in FIGS. 8–12, repeated and continuous clockwise rotation of the first mandrel/first core assembly 161/C1 about the second mandrel/second core assembly 162/C2, and vice versa, as well as continued sliding movement (arrow 192) of the third mandrel/third core assembly 163/C3 towards the first mandrel/first core assembly 161/C1, effectively causes the tensioned length of the photoconductive belt and paper or wrapped assembly 190 to be folded repeatedly about the first mandrel/first core assembly 161/C1 and about the second mandrel/second core assembly 162/C2. After each rotation, the remaining tensioned length of the wrapped assembly 190 becomes shorter and shorter as the second carriage 158 and the third mandrel/third core 163/C3 are pulled in the direction of arrow 192 closer and closer to the first mandrel/first core assembly 161/C1 and the second mandrel/second core assembly 162/C2.

When the remaining tensioned length of the photoconductive belt and paper assembly 190 is essentially zero, the folding is complete, and the three mandrel/core assemblies 161/C1, 162/C2, 163/C3 will be in a row, in perfect alignment with each other, and separated from each adjacent other by the folds of belt 110 and paper 121 between them. Because L2 was greater than L1, when the folding is complete as such, the upper or trail end 124 of the photo paper will be overlapping or overhanging, 125, the resulting or folded belt and paper assembly 200 by about 6 inches. The lower or lead end 122 similarly will be overlapping or overhanging the resulting or folded belt and paper assembly 200 by about 3 inches.

To complete the folding into a tight belt and paper assembly 200, the tucking device 170 is activated and moves upwardly from a position below the overhanging portion 123 of the lower or lead end 122. The purpose of the upward movement is for first tucking the lead end overlapping or overhanging portion 123 of the cut sheet of photo paper around the third mandrel/third core 163/C3 portion of the belt and paper folded assembly 200. The tucking device 170 as such has an upward projecting arm 172 that includes a left to right fixed bend 174 in it (as shown in the drawings). The bend 174 is such that upward motion of the device 170 causes the lead end overhanging portion 123 to be bent up and rightwards (tucked under the upper or trail end overhanging portion 125), as well as around the third mandrel/third core 163/C3 portion of the tightly folded belt and paper assembly 200.

After the lead end overhanging portion 123 of the photo paper has been tucked as above, the hold-down finger 164 (on the second movable carriage) is moved rotatably as shown from a home position above the trail end overhanging portion 125 (that includes the loop tacking portion 126), to deflect such trail end overhanging portion 125 downwards over the tucked lead end overhanging portion 123. The tightly folded belt and paper assembly 200 then starts to move back towards the first and second taping stations, with the tucked trail end being pressed and held tight against the tightly folded belt and paper assembly by the hold-down finger 164.

The tightly folded belt and paper assembly 200 then continues and moves horizontally (to the left) over a vacuum plenum 185 that further grabs the top, tucked trail end 124 of the photo paper, tensions it, and wraps it around a bottom portion of the tightly folded belt and paper assembly 200. The tightly folded belt and paper assembly 200 then continues to move to the left over the first taping station 180 where an adhesive backed loop tacking tape 184 is applied over the tucked trail end overhanging portion 125, through the two punched loop tacking holes or apertures 128, 129, and onto a portion of the tucked lead end 122 underneath. Next, with such continued movement, the second taping station 182 then applies a closure tape or "pull tab" tape 186 over the trail end 124 of the photo paper and over the bottom portion of the tightly folded belt and paper assembly 200. The pull tab tape 186 as such holds the tightly folded belt and paper assembly 200 together. The packaging consisting of wrapping, folding and taping procedures is now complete. The taped tightly folded belt and paper assembly 200 is then moved along the track 150 back to the loading and unloading position AA where the taped tightly folded belt and paper assembly 200, including the packaging core members C1, C2, C3, is unloaded from the packaging machine 100.

The packaging by wrapping, folding and taping in accordance with the present invention is suitable for preventing the photoconductive belt loop 110 from experiencing "light shock" during shipping and installation. This is because it takes the photoconductive belt loop 110 days to fully recover from light shock. In cases where the photoconductive belt loop 110 is relatively large, it is ordinarily very cumbersome to install it onto the photoconductive belt module (not shown) of an image reproduction machine (not shown), and therefore there is even more of a risk of exposing it to room lighting for a longer period of time. In addition, such packaging also prevents the folded portions of the photosensitive layer of the photoconductive belt loop 110 from touching each other, and from being scratched.

In one aspect, the packaging method of the present invention for wrapping, folding and taping a flexible photoconductive belt loop 110 to prevent light from shocking such photoconductive belt loop during shipping and during loading into an image reproduction machine includes (a) supporting and tensioning the flexible photoconductive belt loop 110 over first and second packaging cores C1, C2 mounted on mandrels 161, 162; (b) feeding a light occluding and protective flexible sheet 121 having a lead end 122 and a trail end 124, over the flexible photoconductive belt loop 110 to form a wrapped assembly 190; and (c) forming a loop tacking aperture 128, 129 through a loop tacking portion 126 of the trail end 124 of the light occluding and protective flexible sheet 121.

The method also includes (d) folding the wrapped assembly 190 into a tightly folded pattern around a third packaging core C3 and around one (C1) of the first and second packaging cores C1, C2; (e) applying an end pull tab adhesive tape 186 over the trail end 124 and over a portion of the light occluding and protective flexible sheet 121 underneath the trail end; and (f) applying a loop tacking tape 184 over the loop tacking portion 126, through the loop tacking aperture 128, 129, and onto a portion of the light occluding and protective flexible sheet underneath the loop tacking portion thereof.

In another aspect, the packaging method includes loading the flexible photoconductive belt loop 110 having a circumference L1 over a second movable core C2 and a third movable core C3; moving at least one of the second movable core and the third movable core to tension the flexible photoconductive belt loop; feeding a length of a light occluding and protective flexible member 120 through a fixed arc into a position over the tensioned flexible photoconductive belt loop; first moving the tensioned flexible photoconductive loop horizontally to a first side to position the movable second movable core and a first movable core under the length of the light occluding and protective flexible member; and threading the length of the light occluding and protective flexible member over a portion of the flexible photoconductive belt loop within a threading gap between the second movable core and the first movable core.

The method further includes feeding a rest of the total length of the light occluding and protective flexible member through the threading gap and forming a larger arc thereof; pinching the threaded light occluding and protective flexible member and flexible photoconductive belt loop within the threading gap by moving the first packaging core against the third packaging core; forming at least one loop tacking aperture through a portion of the trail end of the trailing length portion; further moving the tensioned flexible photoconductive belt loop horizontally to the first side causing the light occluding and protective flexible member to wrap itself onto the outside surface of the flexible photoconductive belt loop forming a wrapped assembly 190; rotating the first packaging core and the second packaging core thereby folding the wrapped assembly into a tightly folded belt and paper assembly 200; and tucking the lead end of the light occluding and protective flexible member under the trail end thereof;

Finally, the method includes moving the tightly folded belt and paper assembly horizontally to a second and opposite direction; vacuum grasping, tensioning and wrapping the trail end of the light occluding and protective flexible member (at vacuum plenum 185) around and under the tightly folded belt and paper assembly; applying an adhesive backed loop tacking tape 184 over the trail end, through the at least one loop tacking aperture 128, 129 and onto the lead end; and applying a pull tab adhesive tape 186 over the trailing end, thereby holding the whole tightly folded belt and paper assembly together.

As can be seen, there has been provided a packaging machine and method for wrapping, folding and taping a flexible photoconductive belt loop to prevent light from shocking such photoconductive belt loop during shipping and during loading into a machine. The packaging machine for the method includes mandrels holding cylindrical cores for supporting, tensioning and folding the flexible photoconductive belt loop; devices for feeding a light occluding and protective flexible sheet over the flexible photoconductive belt loop to form a belt and sheet assembly; an aperture former for forming a loop tacking aperture through a loop tacking portion of one end of the light occluding and protective flexible sheet; folding and end-tucking mechanisms for folding the belt and sheet assembly into a tightly folded pattern around the cylindrical cores; and first and second taping stations for applying an end pull tab ape, and a loop tacking tape over the loop tacking portion and through the loop tacking aperture onto a portion of the light occluding and protective flexible sheet underneath the loop tacking portion thereof.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. A packaging machine for wrapping, folding and taping a flexible photoconductive belt loop to prevent light from shocking such photoconductive belt loop during shipping and during loading into a machine, the packaging machine comprising:

(a) a series of movable mandrels holding removable cylindrical cores for supporting, tensioning and folding the flexible photoconductive belt loop;

(b) means for feeding a light occluding and protective flexible sheet over an external surface of the flexible photoconductive belt loop to form a photoconductive belt loop and protective sheet assembly thereof, said light occluding and protective flexible sheet having a first end, and a second end including a loop tacking portion adjacent said second end for overlapping said first end;

(c) an aperture former for forming at least one loop tacking aperture through said loop tacking portion of said second end;

(d) folding and end-tucking mechanisms for folding the photoconductive belt loop and protective sheet assembly into a tightly folded belt and protective sheet assembly around said cylindrical cores; and (e) first and second taping stations for applying an end pull tab piece of tape, and a loop tacking place of tape over said loop tacking portion and through said at least one loop tacking aperture onto a portion of said first end of said light occluding and protective flexible sheet.

2. The machine of claim 1, including a folding station having a tucking device for tucking an overlapping portion of the lead end of the protective sheet around said tightly folded belt and protective sheet assembly of the protective sheet and the photoconductive belt loop.

3. The machine of claim 1, wherein said light occluding and protective flexible sheet is comprised of black photo paper.

4. The machine of claim 1, wherein a plurality of said at least one aperture is formed through said loop tacking portion.

5. A packaging machine for wrapping, folding and taping a flexible photoconductive belt loop to prevent light from shocking such photoconductive belt loop during shipping and during loading into a machine, the packaging machine including:

(a) a protective photo paper holding and supply assembly for holding and feeding a web of protective photo paper;

(b) an arc-shaped paper guide for guiding and positioning a section of fed web of protective photo paper;

(c) a photoconductive belt loop support and folding assembly for supporting and folding the photoconductive belt loop and a sheet of fed photo paper, said photoconductive belt loop support and folding assembly including (i) a wrapping station located above a first portion and underneath a second portion of said arc-shaped paper guide, (ii) a travel track, (iii) a translational first drive means and a rotational second drive means, (iv) a first movable carriage having a first mandrel and a second mandrel each for supporting a first packaging core member and a second packaging core member, and (v) a second movable carriage having a third mandrel for supporting a third packaging core member;

(d) means for folding an assembly of the sheet of fed photo paper and the photoconductive belt loop into a tightly folded belt and paper assembly around said first, said second, and said third packaging core members; and (e) a first taping station and a second taping station located adjacent said travel track for applying an instruction and loop tacking tape over a loop tacking aperture, and a pull tab tape over a second end of said sheet of photo paper and over a portion of said tightly folded belt and paper assembly of the sheet of photo paper and the photoconductive belt loop.

6. The packaging machine of claim 5, wherein said protective photo paper holding and supply assembly includes (i) feed wheels for feeding the web of protective photo paper, (ii) a lead-end sensor for limit-sensing a lead end of a fed web of photo paper; and (iii) a web cutter located upstream of said lead-end sensor relative to a direction of web feed for cutting the fed web of photo paper to a desired length.

7. The packaging machine of claim 5, wherein said arc-shaped paper guide includes a gate therein for reciprocal movement of said first movable carnage and said second movable carriage therethrough.

8. The packaging machine of claim 7, wherein said arc-shaped paper guide includes a removable shutter for closing said gate during feeding of a lead end of a fed web of photo paper across said gate.

9. The packaging machine of claim 7 wherein said gate is located along said arc-shaped paper guide such that a first section of the fed web of photo paper, within said are-shaped paper guide between a lead-end sensor and said gate, is longer than a second section of the fed web of photo paper within said arc-shaped paper guide between said gate and a web cutter.

10. The packaging machine of claim 5, including a folding station having a tucking device for tucking an overlapping portion of a lead end of the sheet of photo paper around said tightly folded belt and paper assembly of the sheet of photo paper and the photoconductive belt loop.

11. The packaging machine of claim 10, wherein said tucking device includes a curved finger and vertical moving means for moving said curved finger into and out of a tucking position.

12. The packaging machine of claim 10, including a horizontal bar for pressing a tucked trail end of said sheet of photo paper over a tucked said overlapping portion of the lead end of said sheet of photo paper.

13. The packaging machine of claim 5, wherein said second carriage includes a hold-down finger for tucking a trail end portion of said sheet of photo paper over a tucked overlapping portion of the lead end of said sheet of photo paper.

14. The packaging machine of claim 13, including means for rotating said hold-down finger from a home position into a deflecting and tucking position for tucking said trail end portion of said sheet of photo paper.

15. The packaging machine of claim 5, wherein said wrapping station includes (i) a loading position having said first carriage and said second carriage spaced a first distance from each other for receiving the photoconductive belt loop in a non-tensioned form, (ii) a tensioning position having said first carriage and said second carriage spaced a second distance from each other for tensioning the photoconductive belt loop about said second and said third packaging core members, and (iii) a threading position having a threading gap between a portion of said photoconductive loop over said second packaging core member and said first packaging core member is located across a gate in said arc-shaped paper guide for receiving a threaded lead end of said fed web of photo paper.

16. The packaging machine of claim 15, including means for moving the photoconductive belt loop tensioned about said second and said third packaging core members through said gate and against said threaded lead end of said fed web of photo paper, thereby pulling an upper section and a lower section of a sheet of photo paper web within said arc-shaped paper guide over the tensioned photoconductive belt loop.

17. The packaging machine of claim 15, wherein said first mandrel having said first packaging core member thereon is movable translationally against said second packaging core member for pinching the fed web of photoconductive paper within said threading gap.

18. The packaging machine of claim 5, wherein each said packaging care member comprises a cylindrical hollow paper core.

19. The packaging machine of claim 5, wherein said first carriage is coupled to both said translational first drive means, and said rotational second drive means.

20. The packaging machine of claim 5, wherein said first mandrel and said second mandrel are rotatable about each other for folding a tensioned photoconductive belt loop and sheet of photo paper assembly into said tightly folded belt and paper assembly.

21. A packaging method for wrapping, folding and taping a flexible photoconductive belt loop to prevent light from shocking such photoconductive belt loop during shipping and during loading into a machine, the packaging method comprising:

(a) supporting and tensioning the flexible photoconductive belt loop over first and second packaging cores mounted on mandrels;

(b) feeding a light occluding and protective flexible sheet having a lead end and a trail end over the flexible photoconductive belt loop to form a belt and sheet assembly;

(c) forming a loop tacking aperture through a loop tacking portion of said trail end of said light occluding and protective flexible sheet;

(d) folding said belt and sheet assembly into a tightly folded pattern around a third packaging core and around one of said first and second packaging cores;

(e) applying an end pull tab adhesive tape over said trail end and over a portion of said light occluding and protective flexible sheet underneath said trail end; and (f) applying a loop tacking tape over said loop tacking portion, through said loop tacking aperture, and onto a portion of said light occluding and protective flexible sheet underneath said loop tacking portion thereof.

22. A packaging method of packaging a flexible photoconductive belt loop to prevent light from shocking said flexible photoconductive belt loop during shipping and during loading into a machine, the method comprising:

(a) loading the flexible photoconductive belt loop having a circumference L1 over a first movable core and a second movable core;

(b) moving at least one of said first movable core and said second movable core to tension said flexible photoconductive belt loop;

(c) feeding a length L2 of a light occluding and protective flexible member through a fixed arc into a position over said tensioned flexible photoconductive belt loop;

(d) firstly, moving said tensioned flexible photoconductive loop horizontally to a first side to position said first movable core and a third movable core under said length L2 of said light occluding and protective flexible member;

(e) threading said length L2 of said light occluding and protective flexible member over a portion of said flexible photoconductive belt loop within a threading gap between said first movable core and said third movable core;

(f) feeding a remainder of a total length L3 of said light occluding and protective flexible member through said threading gap and forming a larger arc thereof;

(g) pinching the threaded light occluding and protective flexible member and flexible photoconductive belt loop within said threading gap by moving said third movable core against said first movable core;

(h) forming at least one loop tacking aperture through a portion of a trail end of a trailing length portion of said protective flexible member;

(i) secondly, further moving said tensioned flexible photoconductive belt loop horizontally to said first side causing said light occluding and protective flexible member to wrap itself onto the outside surface of the flexible photoconductive belt loop thereby forming a wrapped assembly;

(j) rotating said third movable core and said first movable core thereby folding the wrapped assembly into a tightly folded belt and protective flexible member assembly;

(k) tucking a lead end of the light occluding and protective flexible member under the trail end thereof;

(l) moving the tightly folded belt and protective flexible member assembly horizontally to a second and opposite direction;

(m) vacuum grasping, tensioning and wrapping the trail end of the light occluding and protective flexible member around and under the tightly folded belt and protective flexible member assembly;

(n) applying an adhesive backed loop tacking tape over said trail end, through said at least one loop tacking aperture and onto said lead end; and (o) applying a pull tab adhesive tape over the trail end, thereby holding the whole tightly folded belt and protective flexible member assembly together.

* * * * *